US006715736B2

(12) United States Patent
Cummings

(10) Patent No.: US 6,715,736 B2
(45) Date of Patent: Apr. 6, 2004

(54) STEEL PICKET FENCE

(76) Inventor: Tommy Joe Cummings, 298 Jena Ave., Wylie, TX (US) 75098

( * ) Notice: Subject to any disclaimer, the term of this patent is extended or adjusted under 35 U.S.C. 154(b) by 0 days.

(21) Appl. No.: 10/200,641

(22) Filed: Jul. 22, 2002

(65) Prior Publication Data

US 2004/0012007 A1 Jan. 22, 2004

(51) Int. Cl.[7] ..... E04H 17/00
(52) U.S. Cl. ..... 256/24; 256/59
(58) Field of Search ..... 256/19, 24, 25, 256/26, 27, 31, 59, 1

(56) References Cited

U.S. PATENT DOCUMENTS 5,215,290 A * 6/1993 Khalessi ..... 256/19
5,702,090 A * 12/1997 Edgman ..... 256/19
5,725,201 A * 3/1998 Parth ..... 256/24
6,010,117 A * 1/2000 Doxey ..... 256/73
6,398,193 B1 * 6/2002 DeSouza ..... 256/19

* cited by examiner

*Primary Examiner*—John R. Cottingham
(74) *Attorney, Agent, or Firm*—Monty L. Ross; Locke Liddell & Sapp LLP

(57) ABSTRACT

A picket privacy fence that is composed of a plurality of elongated interlocking pickets that form a continuous fencing surface. Top and bottom rails are run horizontally between upright support posts that are set in the ground at regularly spaced intervals. The elongated pickets are positioned vertically between the top and bottom rails. Each picket has a flange on both vertical edges so that adjacent pickets are interlocked using a lap joint thereby preventing any gaps between the elongated pickets. The regularly spaced upright support posts are located within a vertical shaft that passes through the elongated vertical pickets, thereby allowing the elongated interlocking vertical pickets to form a continuous fencing surface.

27 Claims, 7 Drawing Sheets

STEEL PICKET FENCE

BACKGROUND OF THE INVENTION

1. Field of the Invention

This invention relates generally to privacy fences and, more particularly, to picket privacy fences that are durable and relatively easy to assemble.

2. Description of Related Art

Fences of many types are well known in the art for use in both utilitarian and decorative applications. A wide variety of materials are used to construct fences, depending upon cost considerations and the purpose for which the fence is desired. Wood fences typically comprise horizontal rails attached to posts, with vertical pickets in side-by-side relation. For privacy fences, the wood pickets are often overlapped in "board on board" construction. Fences are typically constructed by driving or setting support posts into the ground at desired intervals and the posts are often set in concrete. In some cases, such as a chain link fence, the support posts provide a firm structure to which the flexible fence material is separately attached. In other cases, such as fences made of wrought iron, support posts are integrally formed with the fence structure before being set in the ground.

Materials used for fence construction include different types of wood, metals, fiberglass, various plastics, and combinations thereof. Each material is known to have its advantages and disadvantages in fence construction. Wood fences are particularly susceptible to warping, rotting and insect damage, such as by termites.

Many varieties of known fencing structures are not particularly suitable for privacy fences. For example, chain link fences provide no visual screen and even when slats are added between the links, there are still significant gaps. Wood picket fences contain many gaps as a result of imperfections in the wood, shrinkage, warping, and deterioration of the wood over a number of years. Metal fences are opaque and generally sturdier, but are often considered visually unattractive. Therefore, there remains a need for an effective privacy fence that is visually appealing, relatively easy to erect, and durable enough to withstand many years of use without deterioration or the need for significant maintenance.

SUMMARY OF THE INVENTION

The present invention provides a privacy fence that is both durable and is visually appealing. It is made of a plurality of elongated pickets that are arranged vertically and have flanges on either side so that adjacent pickets are interlocked, thereby eliminating any gaps between the pickets. The pickets are arranged between top and bottom rails that have channels within which the pickets are seated. Regularly spaced vertical support posts, set into the ground and attached to the top and bottom rail, provide the necessary support for the fence. The vertical support posts pass through a hole in the bottom rail and are located in a vertical shaft within a picket. A number of fasteners are used to secure both the rails and the picket to the vertical support post. Because the vertical support posts are hidden within the structure of the fence, the interlocking elongated pickets provide an aesthetically pleasing, continuous fencing surface.

Corners and ends of the fence, including ends next to a gate, are preferably provided with end posts having a fence hook and brackets on any side that a fence section is connected. The fence hook is of the same design as the flange on the pickets so that it can link up with the last picket of the fence thereby providing a seamless transition to the post. The brackets provide additional support to the fence section that is connected to the end post. If the end post is at a gate section, it will also preferably contain either hinges to allow the pivoting of the gate section or hardware to allow the gate to be secured in the closed position. The end post will also preferentially have wrapper and cap structures made of the same material as the pickets and rails, giving the end post the same visual appearance as the rest of the fence.

Further, the fence is preferentially formed in modular components that can be attached together in series and to end posts and gate sections as desired. The modular component contains a plurality of vertically aligned interlocking pickets fastened in place between lengths of top and bottom rail. Modular fence sections eight feet in length are particularly preferred. Holes for the upright support posts are located at each end of the fence section to provide the preferred spacing of the upright support posts. The current invention will be more fully understood with reference to the following detailed description of the preferred embodiment of the invention.

BRIEF DESCRIPTION OF THE DRAWINGS

The apparatus of the invention is further described and explained in relation to the following figures of the drawings wherein.

DETAILED DESCRIPTION OF THE PREFERRED EMBODIMENT

The following description will describe the structure and construction of the claimed fence in terms of the preferred embodiment, which is composed of steel components. However, it will by understood by one skilled in the art that many structural elements of the described fence can also be fabricated out of other materials, such as but not limited to, galvanized sheet metal, fiberglass, aluminum, and various polymers within the scope of the invention.

It is often advantageous to apply a protective coating to the components of the fence. A number of protective coatings are known to those skilled in the art. When steel components are used, it is preferred that a fluoropolymer resin is used, such as polyvinylidene fluoride, which is well known for coating metal materials and provides exceptional resistance to weathering and ultraviolet light. Preferred coatings are polyvinylidene fluorides such as those sold under the trademarks KYNAR 500 and HYLAR 5000, which are commercially available from Berridge Manufacturing Company, located in Houston, Tex. This protective coating can also be used to provide a decorative finish for the fence as it is available in a variety of colors and finishes. To further increase the visual appeal of the fence, it is preferred that the components are embossed with a wood grain pattern prior to the application of the protective coating, so that they can simulate the appearance of a wooden fence.

Figure 1:
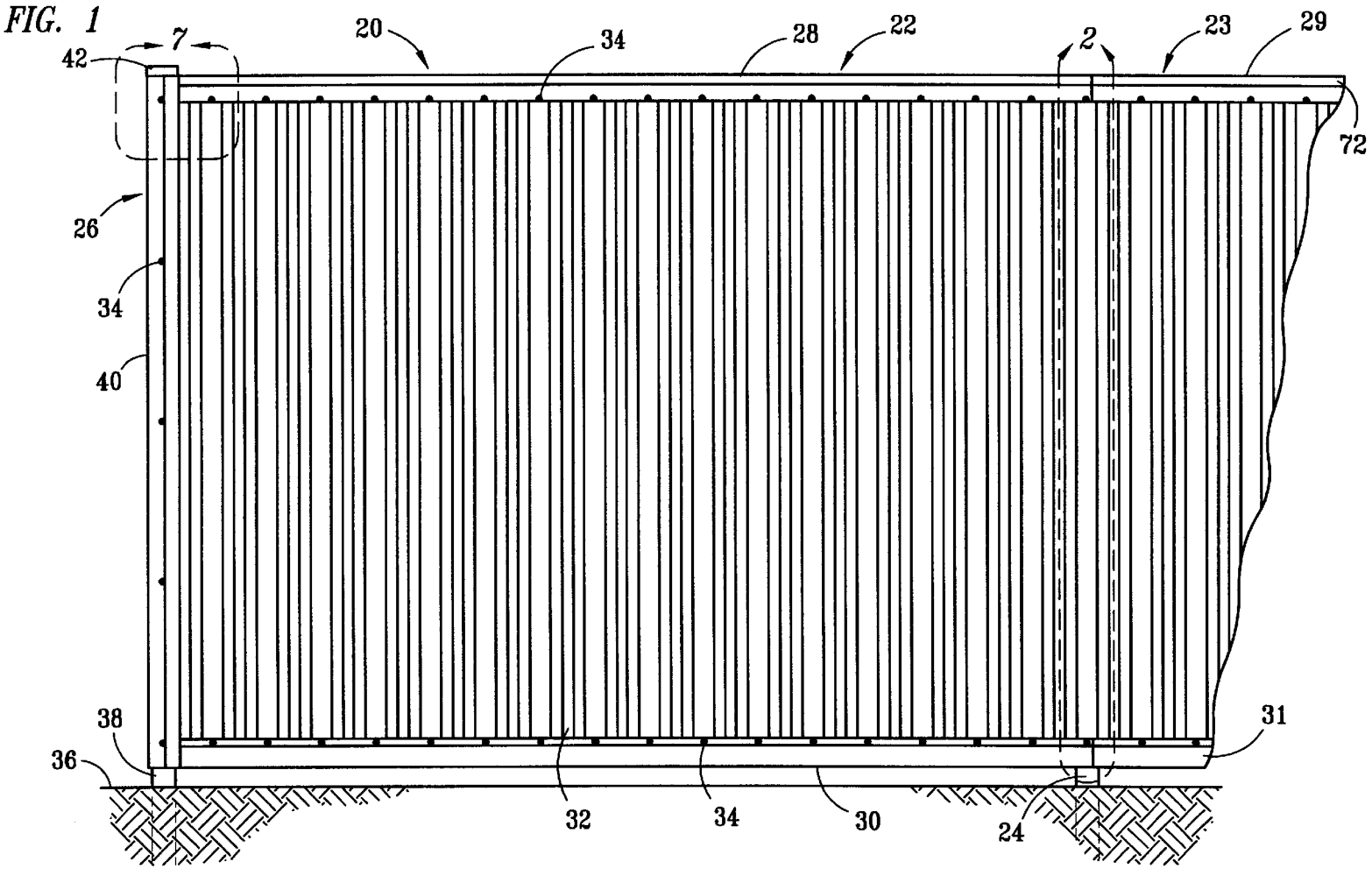
FIG. 1 is a front elevation view of a portion of the installed steel picket fence.

FIG. 1 shows a portion of the installed fence, including a corner post on the left end of the fence. Fence 20 comprises modular components 22 and 23, which can be preassembled in desired lengths, vertical support posts 24 and corner post 26. Each Modular component, as described with respect to modular component 22, preferably comprises top rail 28, bottom rail 30, pickets 32, and fasteners 34. The top of top rail 28 forms capboard 72, which is shaped to simulate a board as attached to the top of some wooden fences to cap off the pickets thereby providing a clean line for the top of the fence. Bottom rail 30 preferably has openings 48 for vertical support posts 24 to pass through the bottom of rail 30, which are visible in FIGS. 6 and 10. A plurality of pickets 32 are aligned vertically between top rail 28 and bottom rail 30.

Pickets 32 are elongated slats that contain flanges on each vertical side (FIG. 3) to allow pickets 32 to interlock with adjacent pickets 32. They are preferentially made of 24–29 gauge steel, and most preferably of 24–26 gauge steel. Vertical support posts 24 are preferably formed of 2 ⅜" diameter steel posts that are set into ground 36 at regular intervals of about 91–92 inches, as measured from the centers of adjacent posts. This distance allows vertical support posts 24 to be positioned where modular components 22 and 23 overlap and are secured together, so that each vertical support post 24 is attached to and provides support for two modular components. Fasteners 34 are used to secure each picket to the top and bottom rail as well as to secure the pickets 32, top rail 28, and bottom rail 30 to vertical support posts 24. Fasteners 34 are preferably long-life, self-drilling or self-tapping screws that have an integral sealing washer. Most preferentially fasteners 34 are "LAP TEK" fasteners, which are commercially available from a number of sources and well known by those of skill in the art for their use in securing metal panels together, especially in metal roofing applications.

With respect to FIG. 1 corner post 26, comprises support post 38, wrapper 40 and cap 42. Wrapper 40 and cap 42 are formed of the same sheet steel as pickets 32, top rail 28 and bottom rail 30, cover support post 38 and give the corner post a visual appearance that matches that of the other components. Comer post 26 also comprises fence hook (FIG. 7) and pole mounting brackets (FIG. 7), which support modular component 22, secure it to corner post 26, and prevent any gaps between the two in order to provide a continuous fencing surface. Alternatively, corner post 26 can merely abut against modular component 22 without being connected to it or providing additional support to the modular component 22. In this case, vertical support posts 24 provide all the required support for modular component 22.

Figure 2:
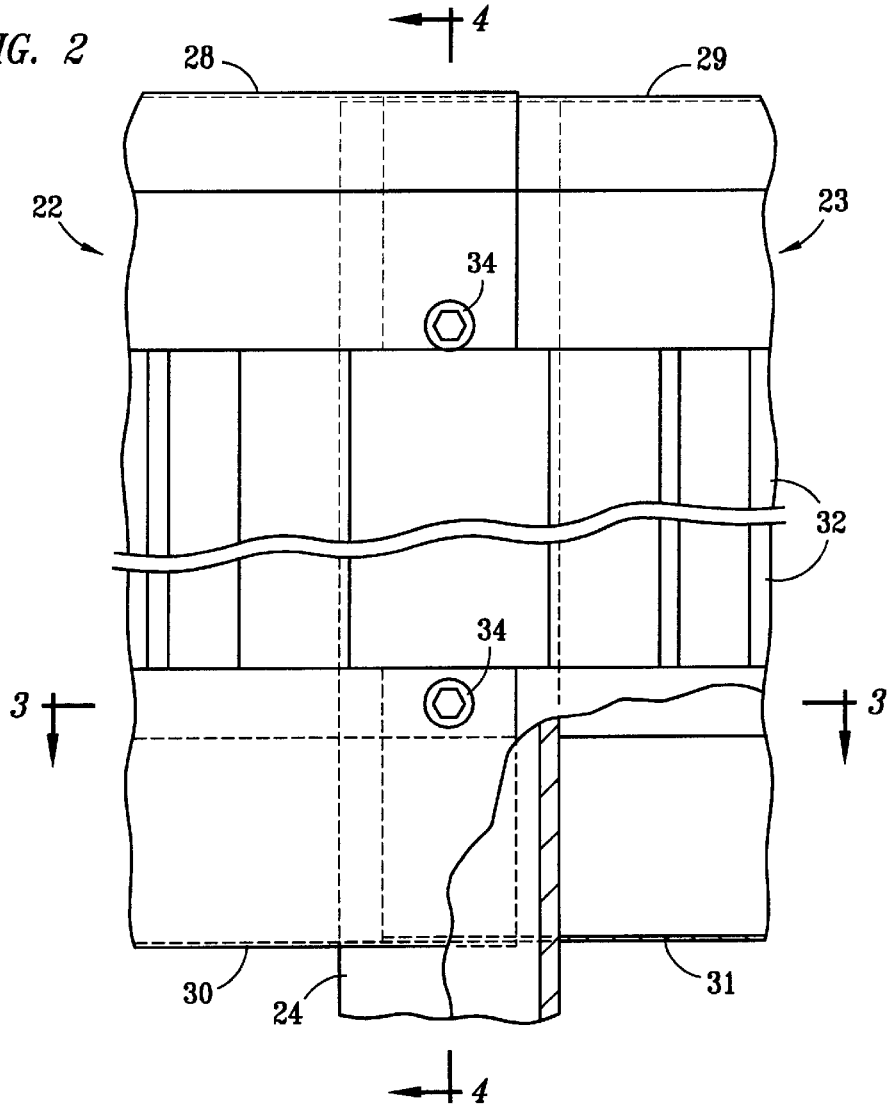
FIG. 2 is an enlarged and partially cut away front elevation view of the area surrounded by line 2 in FIG. 1.

FIG. 2 is an exploded and partially cut away view of the area of FIG. 1 surrounded by line 2. It shows an enlarged view of the location where modular component 22 is joined to modular component 23. Top rail 28 overlaps top rail 29 and bottom rail 30 likewise overlaps bottom rail 31. These overlaps desirably occur at vertical support post 24. As a result of these overlaps, fasteners 34 are able to secure picket 32 as well as both top rails 28 and 29, or both bottom rails 30 and 31, to vertical support post 24.

Figure 3:
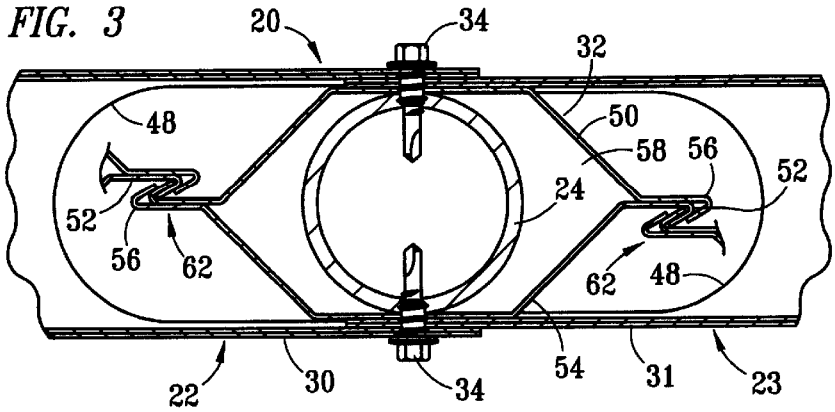
FIG. 3 is an overhead cross sectional view taken along line 3—3 in FIG. 2 showing the interlocking of the metal pickets and the attachment of the pickets and lower rail to the support poles.

FIG. 3 is a cross sectional view taken along line 3—3 of FIG. 2, showing an overhead cross-section of where modular components 22 and 23 are joined. The overlap between bottom rail 30 and bottom rails 31 is more clearly visible, as well as how fasteners 34 secure both bottom rails 30 and 31, and secure picket 32 to vertical support post 24. Vertical shaft 58, which runs through picket 32, is large enough for vertical support post 24 to be positioned therein. This allows modular components 22 and 23 to be securely attached to vertical support post 24 so that fence 20 is held in the proper location and orientation when installed, while allowing interlocking pickets 32 to provide a continuous fencing surface. Support openings 48 are located in the floor of bottom rails 30 and 31 to allow support post 24 to pass through bottom rails 30 and 31.

Each picket 32 is formed of picket halves 50 and 54. Picket halves 50 and 54 are each preferably formed from a sheet of steel. The steel sheet is formed in a bent configuration to form half of the hexagonal cross-section of picket 32. This can be done by conventional methods. Flanges 52 and 56 are formed, for example, by bending the edge of picket halves 50 and 54 back upon themselves at about a 30° angle.

On one vertical side of picket 32, flange 52 seats within flange 56 and on the other side flange 56 seats within flange 52. This arrangement allows flanges 52 and 56 to hold picket halves 50 and 54 together. In addition, the combination of flanges 52 and 56 form one half of lap joint 62 with adjoining picket. Lap joint 62 serves to link pickets 32 together and prevent gaps from forming between them.

Figure 4:
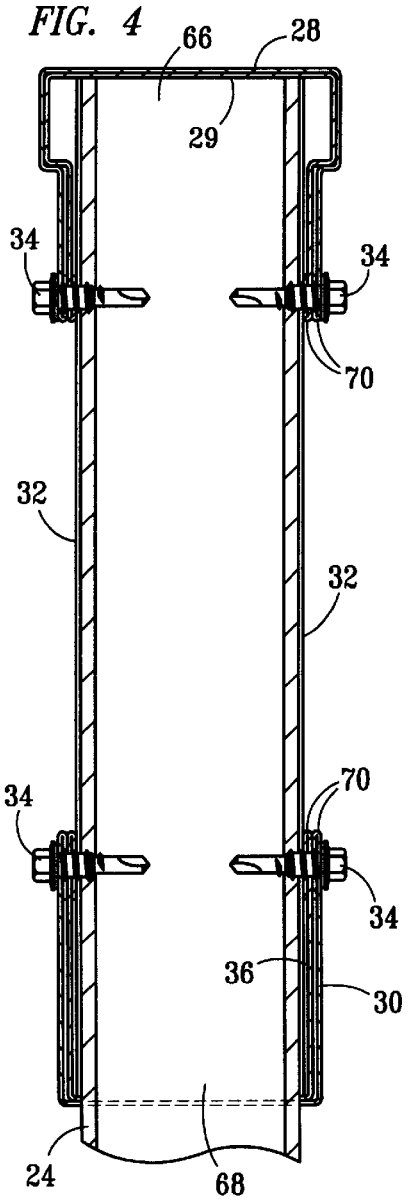
FIG. 4 is a vertical cross sectional view taken along line 4—4 in FIG. 2 showing the juncture between two modular components.

FIG. 4 is a vertical cross section of the junction of modular components 22 and 23 taken along line 4—4 of FIG. 2. Again it clearly shows how top rail 28 overlaps top rail 29 and how bottom rail 30 overlaps bottom rail 31. In addition, downward facing channel 66, formed by top rails 28 and 29 and upward facing channel 68 formed by bottom rails 30 and 31 are now clearly visible. Pickets 32 are seated within upward facing channel 68 and downward facing channel 66. In addition, vertical support posts 24 are seated within downward facing channel 66. Folds 70 at the bottom edges of top rails 28 and 29 and at the top edges of bottom rails 30 and 31 are formed by bending the end portion of the rail back against itself. Folds 70 help to minimize the occurrence of sharp edges when fence 20 is fully assembled and also provide additional material for fasteners 34 to use to support top rails 28 and 29 and bottom rails 30 and 31 to vertical support post 24.

Figure 5:
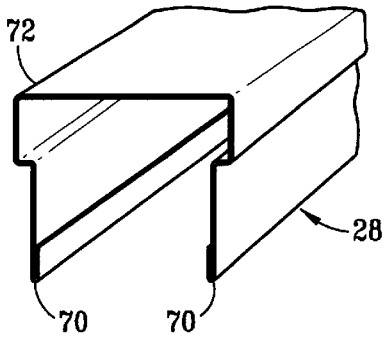
FIG. 5 is a perspective view of the top rail.
Figure 6:
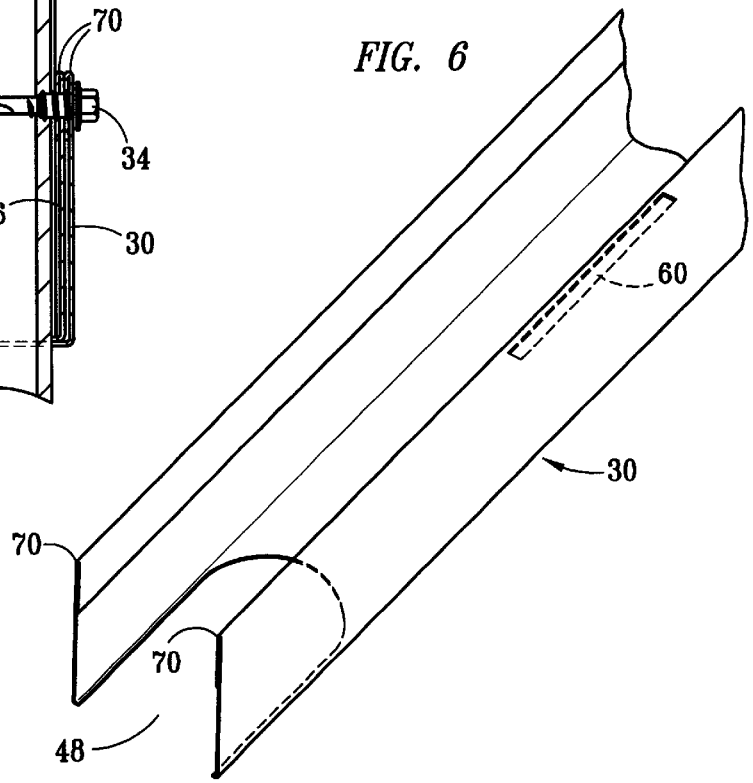
FIG. 6 is a perspective view of the bottom rail.

FIGS. 5 and 6 shows perspective views of top rail 28 and bottom rail 30 respectively. Folds 70 are more clearly visible on top rail 28 in FIG. 5 and on bottom rail 30 in FIG. 6. With respect to FIG. 5 it is also clear that top rail 28 is shaped to form cap board 72. Drainage slots 60 in bottom rail 30 are also depicted in FIG. 6. Finally bottom rail 30 is notched to form support opening 48 that allows vertical support posts (FIG. 1) to pass through bottom rail 30 at each of the ends.

Figure 7:
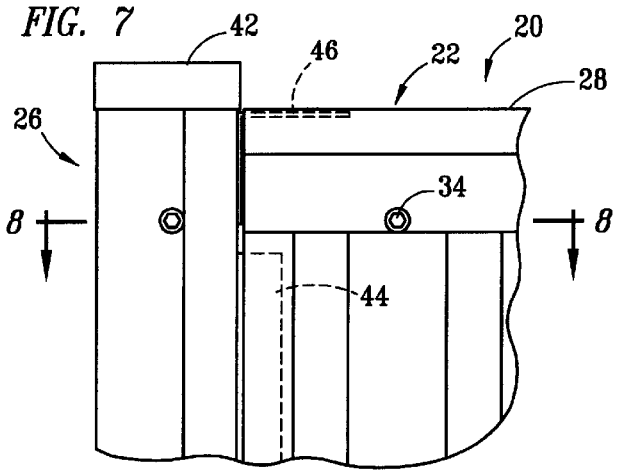
FIG. 7 is an enlarged front elevation view of the section of fence surrounded by line 7 in FIG. 1 showing the junction of a fence section to a corner post.
Figure 8:
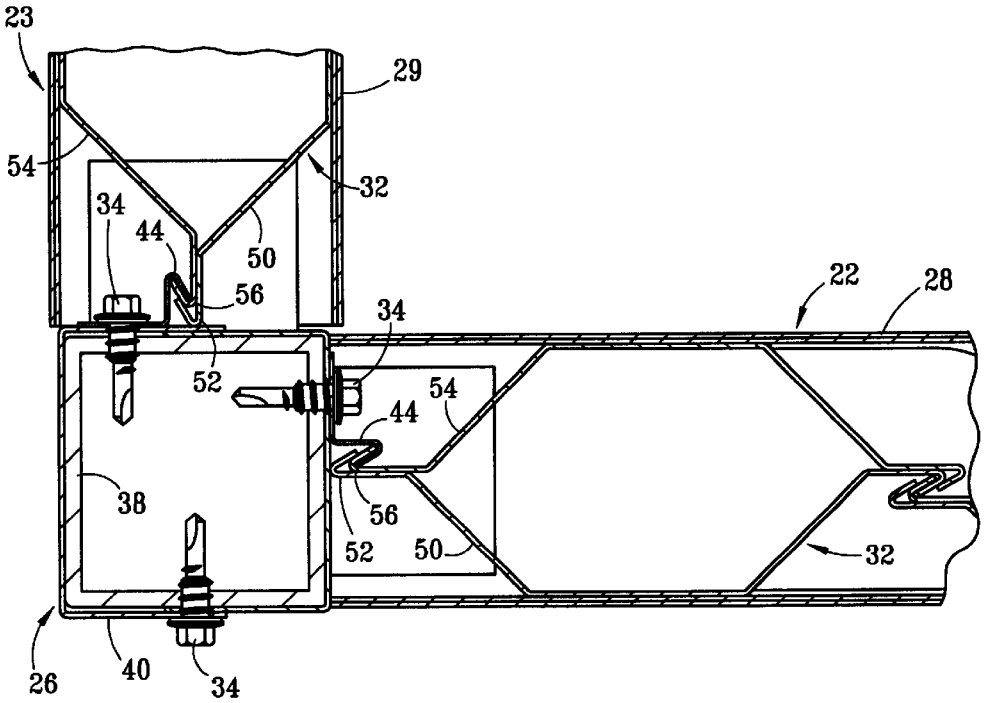
FIG. 8 is an overhead cross sectional view taken along line 8—8 in FIG. 7 showing the junction of two modular fence sections to a corner post.
Figure 9:
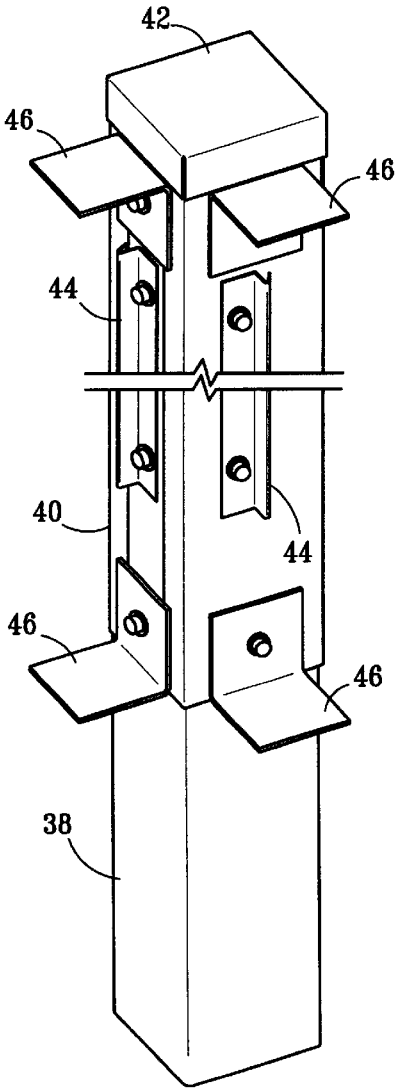
FIG. 9 is a perspective view of a corner post.

FIG. 7 shows an enlarged view of a portion of fence 20 defined by line 7 in FIG. 1. It shows a section of fence 20 where the top of modular component 22 is secured to support post 38. Cap 42 is shown on top of support post 38. The attachment of modular component 22 to support post 38 is shown more clearly in FIG. 8, which is a cross section of fence 20 taken along line 8—8 of FIG. 7. FIG. 8 depicts fence corner 26 constructed around support post 38, which is set in the ground and is preferentially 3" square tubing. Around support post 38 is wrapper 40, which is formed in two overlapping halves and is secured to support post 38 by fasteners 34. Fence hook 44 preferably comprises an elongated base attached to post 38 over wrapper 40, as seen in FIG. 9. Fence hook 44 forms a lap joint 62 with flanges 52 and 56, thereby attaching picket 32 to support post 38 securely and preventing any gaps between the two. Further, pole mounting brackets 46 are also secured to support post 38 and provide additional support for modular component 22. It will be apparent that support post 38 can function as an end post where pickets are attached to only one side. Posts having round or other shaped cross-sections can likewise be used in place of square support post 38 if desired.

FIG. 9 shows a perspective view of support post 38. Wrapper 40 is placed over support post 38 (FIG. 8) so as to cover completely that portion of support post 38 that is adjacent to modular component 20. Cap 42 is secured on the top through a friction fit. Fasteners 34 (FIG. 8) are used to secure wrapper 40 to support post 38. Wrapper 40 and cap 42 are formed of thin sheet steel that is preferably embossed with a wood grain pattern and coated with the same protective coating used on rails 28 and 30 and pickets 32. As a result, support post 38 has the same visual appearance as the remainder of fence 20 and adds to the visual appearance of a continuous fencing surface. In addition, fence hook 44 is shown attached to each side of support post 38 that modular component 22 can be attached. Pole mounting brackets 46 are also attached to the same sides of corner post 26 as fence hook 42. Pole mounting brackets are attached at the height of top rail 28 and bottom rail 30 so that they provide additional support for modular component 22.

Figure 10:
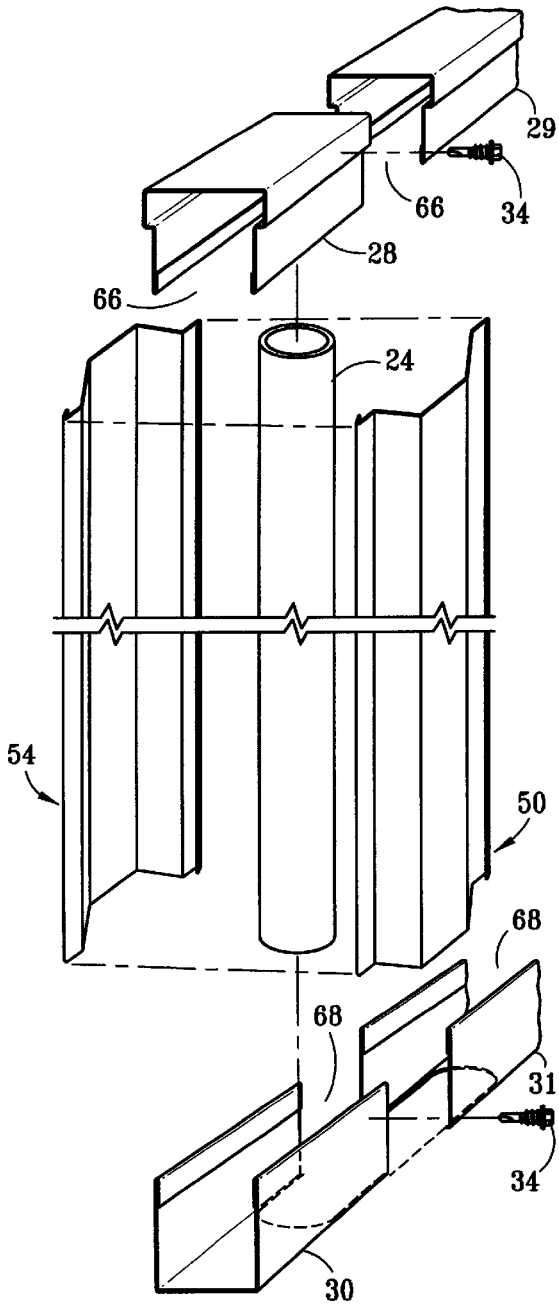
FIG. 10 is an exploded perspective view of the components of the fence at the juncture between two modular components.

FIG. 10 shows an exploded view of fence 20 at the junction between modular components 22 and 23. Vertical support post 24 is surrounded by picket halves 50 and 54. Picket 32 is seated within upward facing channel 68 of bottom rails 30 and 31 and downward facing channel 66 of top rails 28 and 29. Bottom rail 30 overlaps bottom rail 31 on top of vertical support post 24. Top rails 28 and 29 are overlapped in a similar manner. Fasteners 34 are used to secure bottom rails 30 and 31, top rails 28 and 29 and picket 32 to vertical support post 24.

Figure 11:
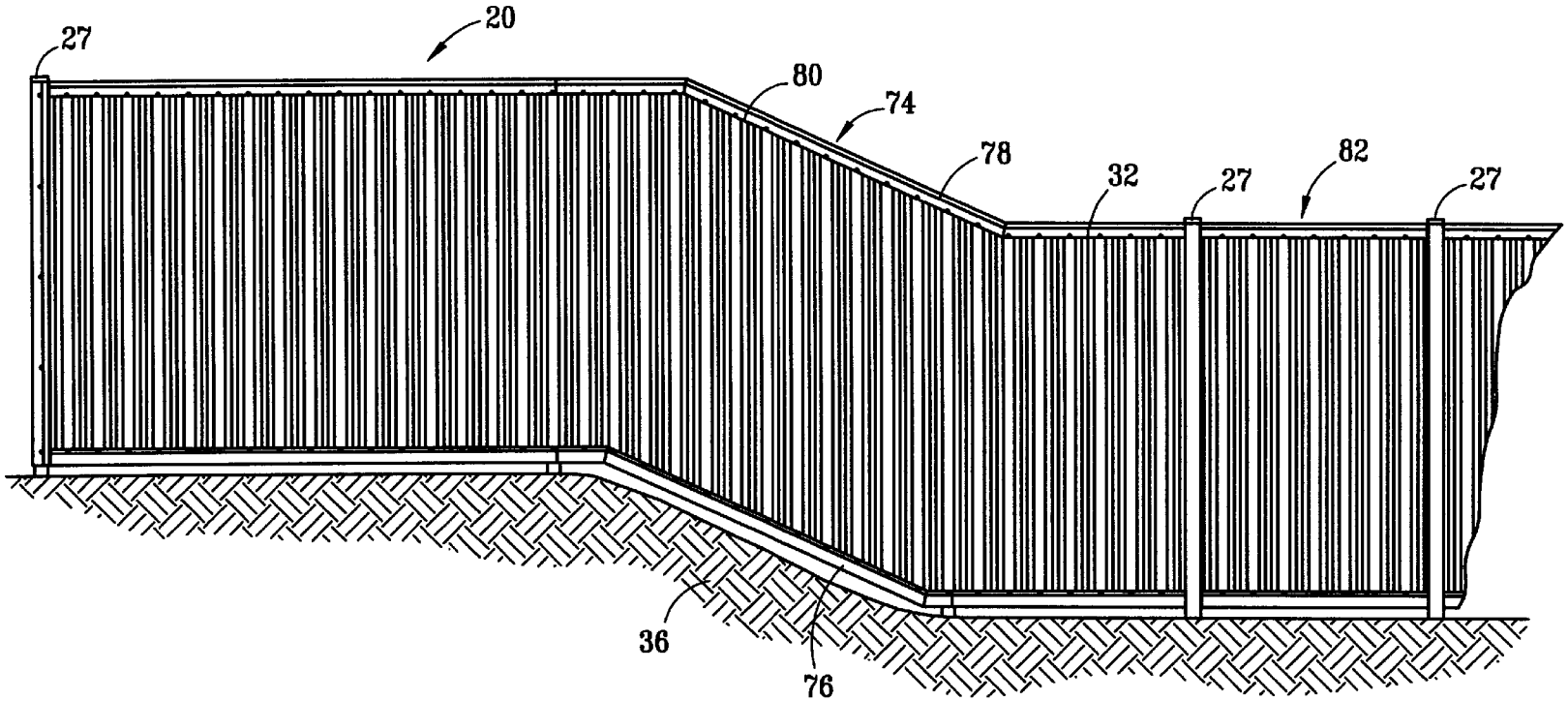
FIG. 11 is a front elevation view of an assembled fence that has an angled modular section to follow the slope of the ground.

With respect to FIG. 11, the disclosed fence can also be used when ground 36 is not flat. This is accomplished by bent modular component 74. Bent modular component 74 comprises bent bottom rail 76, which is shaped with one or more bends in it so that it remains parallel to the ground 36 that is sloped; bent top rail 78, which is shaped with one or more bends in it so that it remains substantially parallel to bent bottom rail 76 along the entire length of bent modular component 74; and, modified pickets 80, which are shaped so that they will properly seat within the channels of bent top rail 78 and bent bottom rail 76, while remaining in substantially vertical parallel alignment with pickets 32. Consequently fence 20 will remain a constant distance above ground 36, with pickets 80 maintaining a consistent vertical appearance along its length, regardless of the slop of ground 36. In addition, FIG. 11 shows a gate in fence 20. Gate section 82 is located between two end posts 27. One post 27 contains hinges (not shown) to pivotally attach gate section 82 to fence 20, and the other end post 27 contains a latch mechanism (not shown) to maintain gate section 82 in alignment with fence 20 when it is not desired to have gate section 82 open to allow passage from one side of fence 20 to the other, in a manner well known to those skilled in the art.

Figure 12:
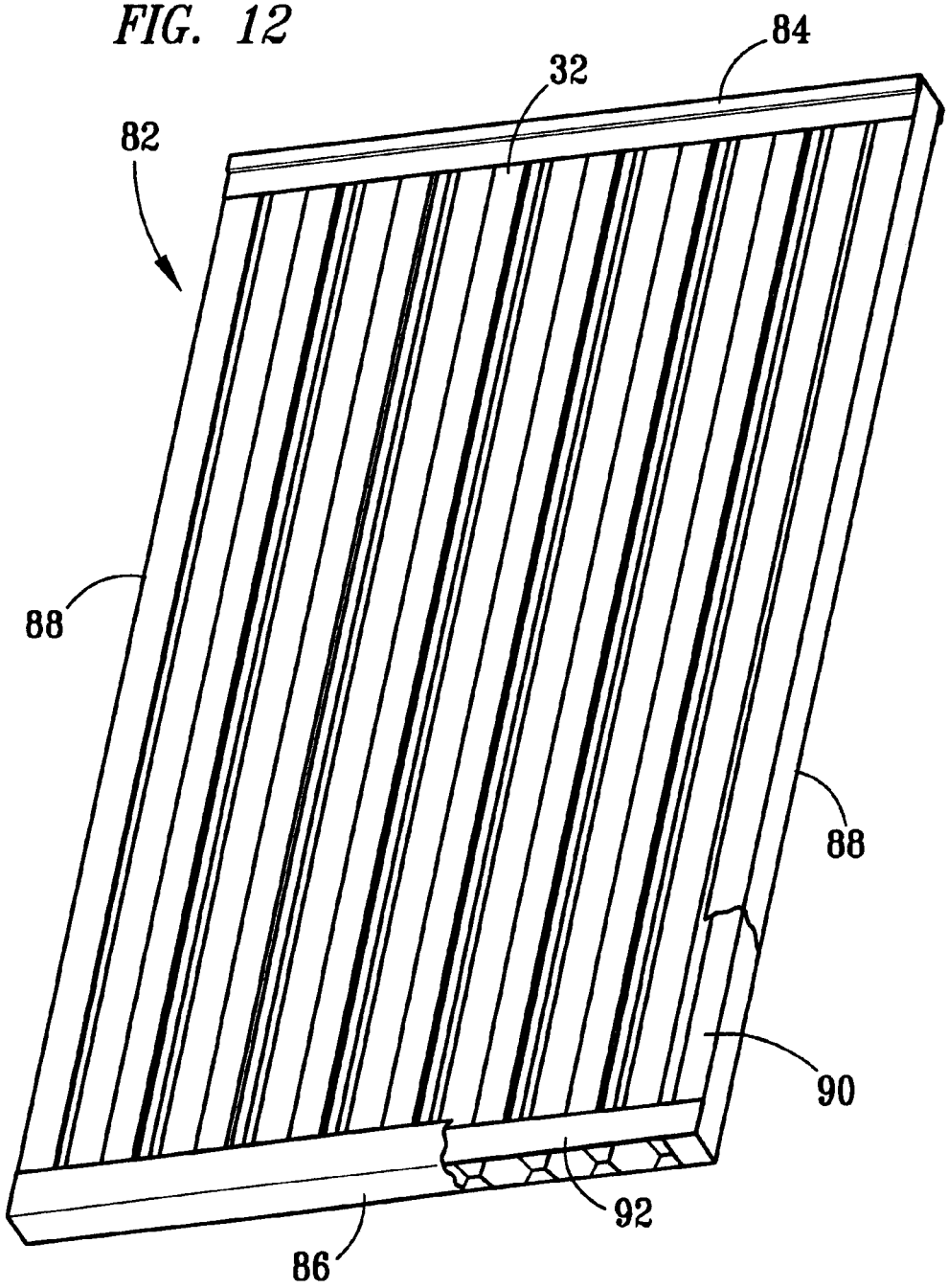
FIG. 12 is a perspective view of a gate section.

As shown with respect to FIG. 12, gate section 82 comprises a plurality of vertically aligned interlocking pickets 32, just like the remainder of fence 20. Gate section 82 is formed by vertical support frames 90 on each side and horizontal support bars 92, which are preferably disposed inside rails 84 and 86 on the top and bottom of gate section 82 to provide additional rigidity. Bars 92 are formed of a material and thickness sufficient to provide the necessary stiffness to keep gate section 82 in the proper shape during use. Gate wrappers 88 are placed over vertical support frames 90 and are constructed in the same manner as wrapper 40 that surrounds end post 26, in order to give fence 20 a consistent visual appearance. Gate top rail 84 is same as top rail 28 but is formed to the width of gate section 82 instead of an eight-foot long section. Gate bottom rail 86 is the same as bottom rail 30 but does not have drainage slots 60 or support openings 48 and is formed to the width of gate section 82 as well. Fasteners 34 (FIG. 11) can likewise be used to secure the components of gate section 82 together in the same way that modular component 22 is secured together.

The above descriptions are made for the purpose of illustration only. Other alterations and modifications of the preferred embodiment will become apparent to those of ordinary skill in the art upon reading this disclosure, and it is intended that the scope of the invention disclosed herein in be limited only by the broadest interpretation of the appended claims to which the inventor is legally entitled.

What is claimed is:

1. A fence comprising, upright support posts adapted to be set into the ground;

a bottom rail forming an upward facing channel and having at least one opening for said upright support posts to pass through;

a top rail forming a downward facing channel;

a plurality of interlocking elongated pickets positioned vertically between said rails, said pickets being seated in said upward facing channel of said bottom rail and said downward facing channel of said top rail, wherein said pickets have flanges on opposing vertical edges forming a linkage with adjacent said pickets;

wherein each said picket contains a vertical shaft where said upright support posts can be located.

2. The fence of claim 1 wherein said pickets comprise two picket halves wherein each said picket half has opposing vertical edges with flanges and wherein one flange on each picket half is adapted to seat within the flange on the other picket half, thereby holding said picket halves together while being adapted to link adjacent pickets together.

3. The fence of claim 2 wherein said picket halves are each composed of a steel sheet formed in a bent configuration to define said vertical shaft between said picket halves wherein said support posts can be located in said shaft.

4. The fence of claim 1 wherein said fence is embossed with a wood grain pattern.

5. The fence of claim 1 wherein said upright support posts are formed of 2⅜" steel pipe.

6. The fence of claim 5 wherein said upright support posts are spaced about 91 inches apart, measured from center of post to center of post.

7. The fence of claim 1 wherein said bottom rail contains longitudinally spaced drain holes centered beneath the linkage between adjacent pickets.

8. The fence of claim 1 wherein said top rail is shaped to simulate a cap board on a wooden fence.

9. The fence of claim 1 further comprising a plurality of fasteners to secure said pickets and said rails to said upright support posts.

10. The fence of claim 1 wherein said bottom and top rails comprise bends so that they remain parallel with a sloping ground and wherein said plurality of pickets comprise angled ends that seat in said upward facing channel and said downward facing channel and wherein said plurality of pickets remain vertically aligned.

11. The fence of claim 1 wherein said fence is composed of steel.

12. The fence of claim 11 wherein said pickets are formed of 24–26 gauge steel.

13. The fence of claim 1 further comprising a protective coating placed on said fence.

14. The fence of claim 13 wherein said protective coating is a fluoropolymer coating.

15. The fence of claim 1 wherein a length of said bottom rail, a length of said top rail, and a plurality of said pickets are secured together to form a modular component.

16. The fence of claim 15 wherein a plurality of said modular components are connected in series to form said fence.

17. The fence of claim 16 wherein said upright support posts are located between adjacent modular components.

18. The fence of claim 1 further comprising an end post comprising a support post, a fence hook on one vertical side adapted to engage the flange of the picket adjacent to said end post, and pole mounting brackets on said vertical side adapted to support said top and bottom rails.

19. The fence of claim 18 wherein said support post is three inch square tubing.

20. The fence of claim 18 further comprising a wrapper and a cap that cover said support post, wherein said wrapper said cap match the appearance of said pickets and said top and bottom rails.

21. The fence of claim 18 further comprising a gate section rotatably coupled to a second vertical side of said end post, said gate section comprising:

a top, bottom, left and right support frames defining the gate section wherein each support frame comprises an inward facing channel;

a bottom rail having an upward facing channel fitting over and covering said bottom support frame;

a top rail having a downward facing channel fitting over and covering said top support frame;

two gate wrappers having inward facing channels fitting over and covering said left and right support frames; and a plurality of elongated interlocking pickets positioned vertically between said top and bottom support frames and seated in the inward facing channel of said top, bottom, left and right support frames, said pickets comprising flanges on opposite vertical edges for linking adjacent pickets together.

22. A fence comprising:

upright support posts adapted to be set in the ground;

a bottom rail forming an upward facing channel and having at least one opening for the upright support posts to pass through;

a top rail forming a downward facing channel;

a plurality of elongated interlocking pickets positioned vertically between the rails, and seated in said upward facing channel on said bottom rail and said downward facing channel on said top rail, wherein said pickets comprise two picket halves and wherein each said picket half has opposing vertical edges where flanges are located wherein one flange on each picket half is adapted to seat within the flange on the other picket half, thereby holding said picket halves together while the combination of said flanges being adapted to form a linkage with adjacent pickets.

23. The fence of claim 22 wherein said picket halves are each composed of a steel sheet in a bent configuration to form said vertical shaft between said picket halves and wherein said flanges on said opposing vertical edges are 'V' shaped hooks.

24. The fence of claim 22 wherein said pickets halves are each composed of a steel sheet in a bent configuration to define a vertical shaft between said picket halves wherein said upright support posts can be located.

25. The fence of claim 22 further comprising longitudinally spaced drain holes centered beneath the linkage between adjacent pickets.

26. The fence of claim 22 further comprising a plurality of fasteners securing said pickets and said rails to said upright support posts.

27. A fence comprising:

upright support posts comprising pipe adapted to be set in the ground;

a bottom rail forming an upward facing channel, comprising at least one opening for the upright support posts to pass through and longitudinally spaced drain holes;

a top rail forming a downward facing channel, wherein said top rail is shaped to simulate a cap board on a wooden fence;

a plurality of elongated interlocking pickets positioned vertically between the rails and seated in said upward facing channel of said bottom rail and said downward facing channel of said top rail, wherein said pickets form a vertical shaft within which said upright support posts can be placed and said pickets have a flange on opposing vertical edges adapted to link adjacent pickets together;

wherein said pickets comprise two picket halves formed from a metal sheet in a bent configuration to define said vertical shaft between said picket halves and each said picket half having opposing vertical edges where flanges are located wherein one flange on each picket half is adapted to seat within the flange on the other picket half, thereby holding said picket halves together while being adapted to link adjacent pickets together;

a plurality of fasteners attaching said pickets to said top and bottom rails and to secure said pickets and said rails to said upright support posts;

a protective coating applied to said fence; and wherein said fence is embossed with a wood grain pattern.

* * * * *